United States Patent [19]

Brundidge et al.

[11] 4,216,702

[45] Aug. 12, 1980

[54] PRESSURE SENSING REGENERATIVE HYDRAULIC SYSTEM

[75] Inventors: Clayton L. Brundidge, Rochester; William H. Bechman, Williamsville, both of N.Y.

[73] Assignee: Eaton Yale Ltd., Ontario, Canada

[21] Appl. No.: 901,545

[22] Filed: May 1, 1978

[51] Int. Cl.[2] ..... F15B 13/042; G05D 11/02

[52] U.S. Cl. ..... 91/436; 137/119

[58] Field of Search ..... 91/29, 436; 137/119, 137/487, 101

[56] References Cited

U.S. PATENT DOCUMENTS

| | | | |
|---|---|---|---|
| 827,823 | 8/1906 | Starr | 251/285 X |
| 3,073,332 | 1/1963 | Strader | 137/119 X |
| 3,335,739 | 8/1967 | Rice | 91/436 X |
| 3,759,144 | 9/1973 | Ikeda | 91/436 |
| 3,967,532 | 7/1976 | Kokaly | 137/596.2 X |
| 4,024,798 | 5/1977 | Schexnayder et al. | 91/436 |
| 4,052,929 | 10/1977 | Baatrup et al. | 91/433 |

FOREIGN PATENT DOCUMENTS

| | | | |
|---|---|---|---|
| 212519 | 8/1957 | Australia | 91/436 |

*Primary Examiner*—Irwin C. Cohen

*Attorney, Agent, or Firm*—R. J. McCloskey; D. Wood; J. G. Lewis

[57] ABSTRACT

A regenerative hydraulic system includes a control circuit having a pressure sensing valve therein. The valve is in fluid communication with a pump and a work cylinder causing the cylinder to be actuated at a relatively high velocity during a first increment of displacement by employing regenerative techniques which interconnect the head and rod sides of the cylinder. Pressure increases due to encountering a load are monitored, and at a predetermined value, the system switches to a non-regenerative mode in which the effective force exerted by the cylinder is substantially increased. Upon switching to the non-regenerative mode, the system is latched and will remain so until the system fluid pressure drops to a second predetermined value which is substantially smaller than the first pressure, resulting in a hysteretic control characteristic which will prevent an unstable condition. A dual rate spring is included within the valve urging it into the regenerative position. The disclosed hydraulic system can be employed in tree harvesters and virtually any other type of hydraulic system including a work cylinder or its equivalent.

13 Claims, 9 Drawing Figures

FIG. 6.
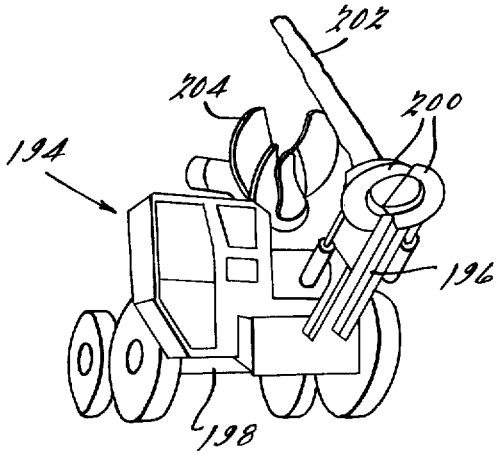
FIG. 7.
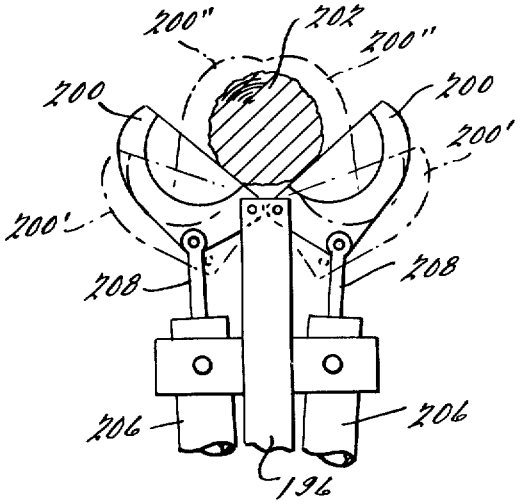
FIG. 8 a.
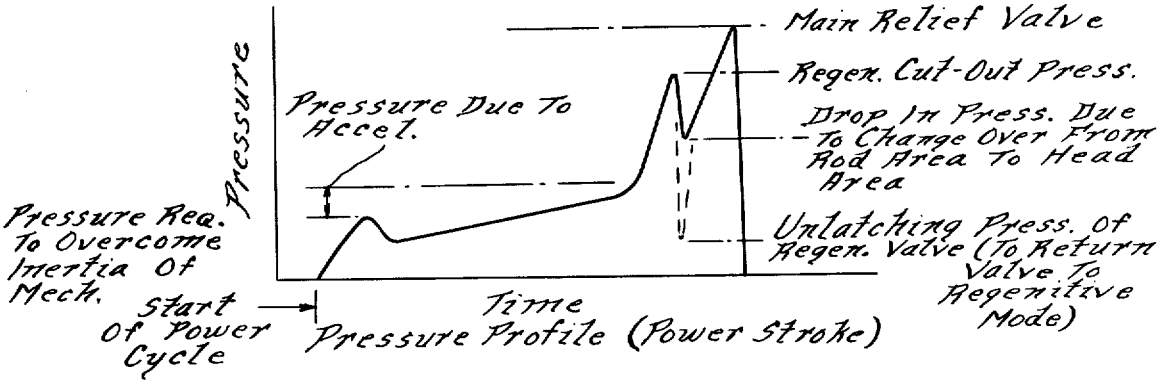
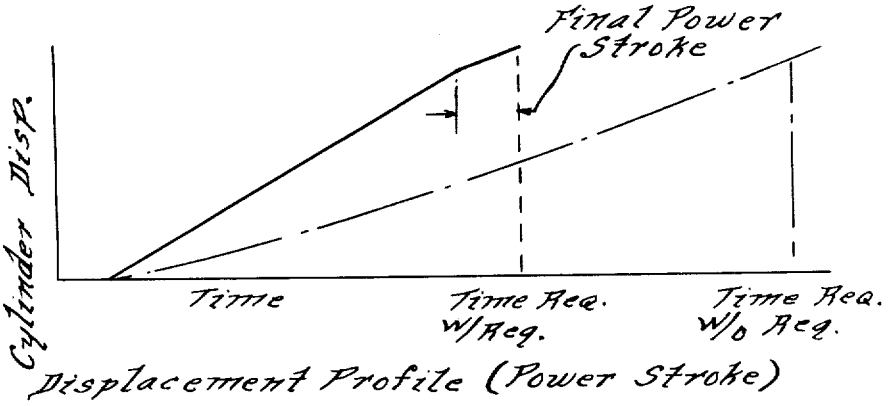
FIG. 8 b.

PRESSURE SENSING REGENERATIVE HYDRAULIC SYSTEM

FIELD OF THE INVENTION

This invention relates to regenerative hydraulic systems in general and specifically to regenerative hydraulic systems including pressure sensing control circuitry in which system pressure is varied as a function of the load encountered by the system.

DESCRIPTION OF THE PRIOR ART

Hydraulic systems have long been used in machinery such as jacks, lifts, bending machines, construction and harvesting equipment and the like. Individual work cylinders within such equipment are typically controlled by one or more hydraulic valves and associated hydraulic circuitry. To reduce machine cycle time and to increase the effective power of the work cylinder upon encountering a load, regenerative techniques have been employed in which the head side and rod side of a given work cylinder are interconnected during initial displacement of the mechanism. By definition, the system is in a regenerative mode when head and rod sides are so interconnected. When a load is encountered, the fluid path between the rod side and head side of the work cylinder is interrupted and only fluid from the system pump is supplied to the work cylinder thereby substantially increasing the effective force exerted by the work cylinder. The system thus switches from the regenerative to a non-regenerative mode. This arrangement allows hydraulically controlled machinery to move quickly relative to a work piece while operating at a low power level and then effectively increase the power applied when a load is encountered. Additionally, if the load encountered varies substantially from one piece or operation to another, overall system efficiency is enhanced in that when low power demands are made on the system, cycle time is increased but when large power demands are made, the applied power is increased appropriately.

A typical regenerative hydraulic device is disclosed in U.S. Pat. No. 3,759,144 to Ikeda. Ikeda discloses a system in which during the outward stroke of a work cylinder, fluid displaced thereby is routed to the head side of the cylinder combining with the fluid from the pump or pressure source, thereby increasing the displacement rate of the work cylinder, piston and connecting rod. When a load is encountered by the rod its associated mechanism, the pressure on both sides of the piston increases. When the pressure reaches a predetermined level, a valve assembly in the control circuit switches, thereby routing the fluid displaced by the piston to the holding tank of the pump. By so doing, the volume of fluid being pumped to the head side of the work cylinder piston is decreased, but the effective pressure applied by the cylinder upon the load is substantially increased. If the load decreases to the point where the fluid pressure drops below the predetermined value, the control circuit switches the fluid being expelled from the hydraulic cylinder back to the head side thereby again increasing the volume of fluid flow to the head side of the work cylinder and thus, increasing its outward displacement velocity.

A shortcoming of prior art devices of this type is that when the load encountered by the work cylinder generates a system fluid pressure which fluctuates on either side of the predetermined system switching pressure, the system will become unstable, rapidly switching into and out of the regenerative mode. This condition is unsatisfactory in that it makes the mechanism difficult to control under certain operating situations. Additionally, operation of a regenerative device in an unstable condition can result in undesirable transient pressures and reduced life expectancy.

SUMMARY OF THE INVENTION

The present invention overcomes the shortcomings of prior art regenerative hydraulic systems by providing a control circuit which senses system fluid pressure, switches from the regenerative mode into the non-regenerative mode at a first relatively high predetermined pressure and switches back into the regenerative mode at a second relatively low predetermined pressure. This hysteretic control effect prevents the system from switching into and out of the regenerative mode in a rapid manner as is possible in prior art devices. A significant reduction in the load encountered by the work cylinder is required before the system can switch back into the regenerative mode.

The hysteretic control effect is accomplished by a pressure sensing valve incorporated within a hydraulic system control circuit. Such a system also includes a pressure source or fluid pump, a directional valve arrangement, and a hydraulic actuator such as a work cylinder in addition to the pressure sensing valve. The hydraulic actuator operates a work element associated with the system. The valve has a body with a longitudinal bore therethrough within which is disposed a plunger which is axially displaceable between two limits of travel. A number of ports are in fluid communication with the bore and are interconnected with one another depending upon the position of the valve plunger. The valve plunger is urged into one of its axial limits of travel by a biasing means such as a spring. This is the regenerative position in which two of the ports in fluid communication with one another are arranged to interconnect the head side and rod side of the system work cylinder. A plunger latching mechanism is provided which monitors the system pressure and at a predetermined value displaces the plunger to its other limit of travel thereby switching the system to the non-regenerative mode. Once switched into the non-regenerative mode, the valve plunger will remain in that position until the system pressure drops below a second predetermined value which, in application, is much lower than that of the initial or first value. Thus, when the work element first encounters a load, a certain relatively high fluid pressure must result before the system will switch out of the regenerative mode. However, as the load decreases upon completion of the operation or for any other reason, the system pressure must drop to a point much lower than that required for the initial switching from the regenerative to the non-regenerative mode. This is the hysteretic effect which is a major advantage of the present invention.

In the preferred, illustrative embodiment of the invention, the system is applied to a tree harvester, the shearing mechanism of which being the working element. The harvester includes a mechanism which first embraces and then severs a tree from its root system by the shearing action of a pair of blades linked with corresponding work cylinders. Because the trees vary substantially in diameter and texture, the load profile of the mechanism will vary substantially during a single cut and also between subsequent operations of the mechanism. The present invention has the advantage of a relatively fast cycle time and system stability during transitions between the regenerative and non-regenerative mode. The hysteretic control characteristic is achieved by an extremely efficient, simple and inexpensive valve which can be readily adapted to an existing system.

The preferred embodiment of the valve comprises a housing with a longitudinal bore, the bore containing a valve spool of conventional design. Three ports are in fluid communication with the bore and are spaced axially therealong. The valve spool is urged into a first limit of travel, representing the regenerative position, by a double rate spring. A first pilot piston is slidably disposed in a bore coaxial with the longitudinal bore and abuts one end of the valve spool. The other end of the pilot piston abuts a second pilot piston which is of substantially larger diameter than the first. The second pilot piston is slidably disposed in a second pilot bore also coaxial with the longitudinal bore. The end of the second pilot bore nearest the valve spool is in fluid communication with the port within the valve which is in fluid communication with the rod side of the work cylinder. The other end of the second pilot bore is in fluid communication with the port that is in fluid communication with the head side of the work cylinder. Thus, as the piston within the work cylinder begins to be displaced outwardly at the beginning of a cycle, the valve is in the regenerative mode with one end of the small pilot piston abutting the valve spool and the other end of the small pilot piston abutting the larger pilot piston. As a load is encountered, the system pressure increases, and at predetermined level, the small pilot piston pushes the valve spool to its other limit of travel thereby switching the valve and the system from the regenerative mode to the non-regenerative mode. Consequently, the large pilot piston detects a pressure differential between its ends causing it to be displaced axially to again abut the small pilot piston thereby latching the system in the non-regenerative mode. During the completion of the cycle the system pressure typically increases to a peak and then falls off as the tree is severed. If for some reason, however, the load drops, for example if a hollow tree is being severed, the system pressure may drop below the value at which the valve switched from the regenerative mode to the non-regenerative mode. However, because of the latching feature, the system will remain in the non-regenerative mode until the cycle is complete or the system pressure drops substantially below the initial switching pressure at which time the valve will switch back to the regenerative mode.

Various other features and advantages of this invention will become apparent upon reading the following specification, which along with the patent drawings, describes and discloses a preferred, illustrative embodiment of the invention.

The invention makes reference to the accompanying drawings.

BRIEF DESCRIPTION OF THE DRAWINGS

FIG. 6 is a perspective view of a tree harvester embodying the regenerative hydraulic system of FIG. 5;

FIG. 7 is a plan view of the shearing mechanism employed in the tree harvester of FIG. 6;

FIG. 8A is a pressure-time graph illustrating the pressure profile of the regenerative hydraulic system of FIG. 5 during a typical power stroke of the shearing mechanism of the harvester of FIG. 6;

FIG. 8B is a displacement-time graph illustrating the displacement profile of the regenerative hydraulic system of FIG. 5 during the same power stroke.

DETAILED DESCRIPTION OF THE PREFERRED EMBODIMENT

Figures 1, 2, 3, 4:
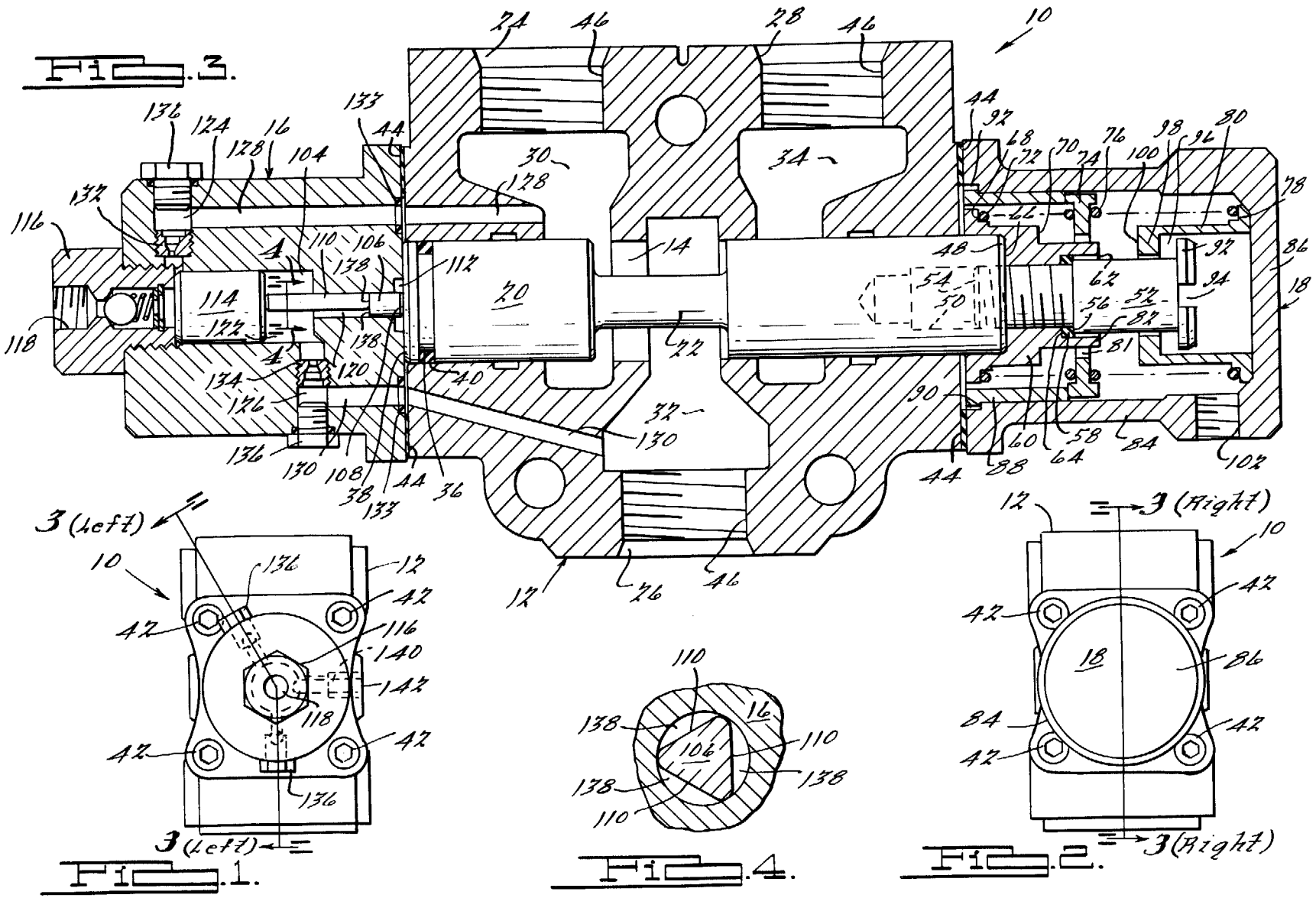
FIG. 1 is an end elevational view of the preferred embodiment of a pressure sensing valve.
FIG. 2 is the other end elevational view of the valve of FIG. 1.
FIG. 3 is a cross sectional view shown on line 3—3 of FIG. 1 and FIG. 2.
FIG. 4 is a cross sectional view taken on line 4—4 of FIG. 3.

Referring to FIGS. 1, 2, and 3 the preferred embodiment of a pressure sensing valve 10 is illustrated. The pressure sensing valve 10 comprises a valve housing 12 having a longitudinally disposed bore 14 therethrough. The bore 14 is closed at one end by an actuator housing 16 and at the other end by a spring cover 18. A valve spool 20 is axially slidably disposed within the bore 14. The valve spool 20 has a centrally disposed portion 22 having a reduced diameter the purpose of which will be described in detail below. The valve housing 12 has three ports 24, 26, 28 therein, each said port 24, 26, 28 being in open communication with the bore 14 through an intermediate cavities 30, 32, 34. The valve housing 12 is preferably constructed of cast metal, the cavities 30, 32, 34 being voids created during the casting process. However, it is contemplated that the cavities 30, 32, 34 as well as the ports 24, 26, 28 could be formed by machining processes well known to those skilled in the art. The location along the bore 14 at which each cavity 30, 32, 34 communicates therewith is longitudinally spaced from the others. This spacing, along with the dimension of the portion of the valve spool 20 having a reduced diameter 22 permits differing combinations of cavities 30, 32, 34 to be in open communication with one another depending upon the axial position of the valve spool 20. The valve spool 20 is illustrated in its left hand most limit of travel in which its left hand most end 38 abuts the actuator housing 16. In this position a path of open communication is defined through the valve 10 by port 24, cavity 30, longitudinal bore 14, cavity 32 and port 26. Communication with port 28 is blocked by the valve spool 20. The valve spool 20, as illustrated in FIG. 3, is slidably displaceable to the right. The right hand most limit of travel is determined by structure within the spring cover 18 which will be described in detail below. When the valve spool 20 is in its right hand most limit of travel a path of open communication through the valve 10 is defined by port 26, cavity 32, longitudinal bore 14, cavity 34 and port 28. Port 24 is blocked by the valve spool 20. Thus, it can be seen that port 26 will alternatively communicate with port 24 or port 28 depending upon the position of valve spool 20.

Proximate the left hand most end 38 of the valve spool 20 is a second portion of reduced diameter 36 within the valve spool 20 which accommodates a conventional O-ring 40 for sealing purposes. The actuator housing 16 and spring cover 18 are mechanically affixed to the valve housing 12 by cap screws 42 or other suitable fastening means. Gaskets 44 are included intermediate the actuator housing 16 and valve housing 12 as well as the spring cover 18 and the valve housing 12. The ports 24, 26, 28 are threaded 46 to accommodate standard hydraulic fittings for interconnection with the rest of the system as will be described in detail below.

The right hand most end 48 of the valve spool 20 has a bore 50 therein which threadably receives one end 54 of an adjustable stop 52. The stop 52 has a step 56 which abuts the right hand most end of a washer shaped spacer 58 encircling the threaded end 54 of the stop 52. The threaded end 54 of the adjustment stop 52 passes through a central aperture 62 of a spring seat 60 before engaging the bore 50 of the valve spool 20. Within the bore 62 is a step 64 which abuts the left hand most end of the spacer 58. Also, within the central aperture 62 is a second step 66 which abuts the right hand end 48 of the valve spool 20. The valve spool 20, the adjustable stop 52, the spacer 58, and the spring seat 60 reciprocate as a single assembly.

The spring seat 60 has two steps 68 and 70 on its outside surface. Step 68 abuts the left hand end of a biasing spring 72 the other end of which abuts the left hand most surface of a floating spring seat 74. The right hand most surface of spring seat 74 abuts a second biasing spring 76 the other end of which abuts a step 78 in a fixed spring seat 80. The floating spring seat 74 is substantially washer shaped having a large aperture 81 centrally disposed therein through which passes the adjustable stop 52 and the right hand most end portion 82 of the spring seat 60.

Spring cover 18 is substantially hollow, having a cylindrical wall portion 84 and an end portion 86. Disposed within the spring cover 18 is a cylindrical stop 88 the left hand end of which abuts the valve housing 12 and the right hand end of which abuts the floating spring seat 74 when the valve 10 is in the position illustrated. The left hand most end of the stop 88 has a step 90 which nests within a recess 92 in the wall portion 84 of the spring cover 18 thereby preventing displacement of the stop 88. The right hand most end of the spring seat 80 abuts the inside surface of the end portion 86 of the spring cover 18. Springs 72 and 76 are always under a slight compression load and thus, are always urging the valve spool 20 and its associated assembly to the right or into the position illustrated.

The adjustable stop 52 has a stepped head 92 with a transverse adjustment slot 94 therein which is used during the assembly and calibration of the valve 10. The spring seat 80 has a central aperture 96 through which passes the adjustable stop 52. The spring seat 80 has an area of radially inwardly increasing wall thickness 98 adjacent the left hand end thereof. This thickened area 98 defines a stop 100 the function of which will be described in detail below.

The springs 72 and 76 have different spring rates, the combined effect of which is to produce a double rate curve. In the preferred embodiment, spring 72 has a 150 pound per inch rate and spring 76 has a 65 pound per inch rate. It is contemplated, however, that greatly varying rates could be employed depending upon a specific application which would be obvious to one skilled in the art. The purpose of the double rate curve is to allow the spool 20 to be displaced from the illustrated position toward the right or the second position in a manner where during the first increments of displacement a relatively low force is required but after a given displacement a larger force is required to fully shift the valve spool 20 into the second position. The primary reason for this arrangement is to counteract the Bernoulli forces upon the valve spool 20 during switching. The effect of Bernoulli forces in hydraulic valves is well known and will not be elaborated upon here.

In operation, as the valve spool 20 is being displaced from the first position to the second position, spring 76 having the lower rate will tend to collapse first. As the displacement of the valve spool 20 continues the floating spring seat 74 will approach the fixed spring seat 80, the right hand most surface of spring seat 74 will eventually abut stop 100 of spring seat 80. This condition is the right hand most limit of travel for the floating spring seat 74 and further displacement of the valve spool 20 will cause spring 72 to begin to collapse. As this occurs step 70 of spring seat 60 approaches and eventually abuts the left hand most surface of the floating spring seat 74 thus, defining the right hand most limit of travel of the valve spool 20 and its associated assembly. A threaded tank port 102 is provided in the lower most wall portion 84 of the spring cover 18, the function of which will be described in detail below. Briefly stated however, this port 102 permits fluid to be returned to the system which may seep into the spring cover 18 between the valve spool 20 and the bore 14.

The actuator housing 16 has a stepped bore 104 therethrough which is coaxial with the longitudinal bore 14 within the valve housing 12. The portion of the stepped bore nearest the valve spool 20 is of relatively small diameter within which is slidably disposed a small pilot piston 106. The right hand most end 108 of the pilot piston 106 abuts the left hand most end 38 of the valve spool 20. The small pilot 106 is cylindrical and has coaxial flats 110 running approximately 75% of its length. The portion of the length of the small pilot piston 106 which does not contain flats 110 is that nearest the valve spool 20. A small counterbore 112 is cut into the end of the actuator housing 16 adjoining the valve housing 12 coaxially with the stepped bore 104 for reasons described herein below.

The stepped bore 104 steps radially outwardly at a point approximately one half of the length of the small pilot piston 106 displaced from the valve housing 12. Within this portion of the stepped bore 104 is slidably disposed a large pilot piston 114. The left hand end of the stepped bore 104 is closed by a check valve 116 of conventional design. A port 118 entering the check valve 116 is threaded to accommodate standard hydraulic fittings. The function of the check valve will be described in detail herein below. For the purposes of this specification the portion of the stepped bore 104 between the counterbore 112 and the radial step described hereinabove will be defined as the small pilot bore 120 and the portion of the stepped bore 104 between the radial step and the right hand most end of the check valve 116 will be defined as the large pilot bore 112. The right hand most end of the large pilot piston 114 abuts the left hand most end of the small pilot piston 120 in the position illustrated in FIG. 3.

FIG. 4 illustrates a cross sectional view of the small pilot piston 106 and the surrounding portion of the actuator housing 16 illustrating the configuration of the flats 110 of the small pilot piston 106. Although flats 110 are illustrated, numerous variations would be obvious to one skilled in the art in light of this specification. For the purpose of this specification "flat means" is broadly defined as any structural variation in the pilot piston 106 and associated bore 120 which results in the pilot piston 106 functioning as described herein. Examples of such variations are bores, keyways, slots, spools, and the like which are substituted in the pilot piston 106 in place of the flats 110.

Referring to FIG. 3, radial bores 124 and 126 are made in the actuator housing 116 into the left hand and right hand end of the large pilot bore 122 respectively. Bore 124 is in open communication with cavity 30 through passageways 128 within the actuator housing 16 and the valve housing 12. Bore 126 is in open communication with cavity 32 through passageways 130 in the actuator housing 16 and the valve housing 12. The passageways are sealed by means of conventional O-rings 133. Bores 124 and 126 have orifices 132 and 134 threaded therein respectively. Additionally, seal plugs 136 are provided to close both bores 124 and 126.

The fluid pressure in cavity 32 is detected by or impressed upon the right hand end of the large pilot piston 114 and the crescent shaped steps 138 of the small pilot piston 106 at the point of transition adjacent the right hand most end of the flats 110. Thus, any fluid pressure in cavity 32 would tend to push the small pilot piston to the right and the large pilot piston to the left. Any fluid pressure in cavity 30 would be impressed upon the left hand end of the large pilot piston 114 tending to push it to the right. With the valve 10 in the position illustrated, large pilot piston 114 would thus have forces impressed on it tending to push it in both directions simultaneously. In a typical application, with the valve spool 20 in the position illustrated, the pressures in cavities 30 and 32 would be substantially the same. Orifice 132 is slightly smaller than orifice 134 whereby in such a condition, the pressure applied on the right hand end of the large pilot piston 114 would be slightly larger than that applied to the left hand end thereby insuring that the large pilot piston will remain in its left hand most limit of travel. At the same time, the pressure in cavity 32 would tend to force the small pilot piston 106 to the right against the valve spool 20 in opposition to the urging of the springs 72 and 76. The area in which the fluid pressure is actually applied to the small pilot piston 106 is on the three crescent shaped flat 138 adjacent the right hand most edge of the flat 110.

Referring to FIG. 1 a third radially disposed bore 140 within the actuator housing 16 is in open communication with the end of the longitudinal bore 14 in the valve housing 12. Radially disposed bore 140 terminates in a threaded tank port 142. Bore 140 is used as a drain as will be hereinunder described in detail.

Referring to FIG. 3, it should be noted that the cross sectional view of the actuator housing 16 is a two plane section as is denoted in FIG. 1 while the section through the valve housing 12 and spring cover 18 is a single plane section as indicated in FIG. 2. Although the section lines illustrated in FIG. 1 and FIG. 2 do not appear to be consistent with one another, FIG. 3 is presented with the intent to more clearly illustrate the internal details of the valve 10.

Figure 5:
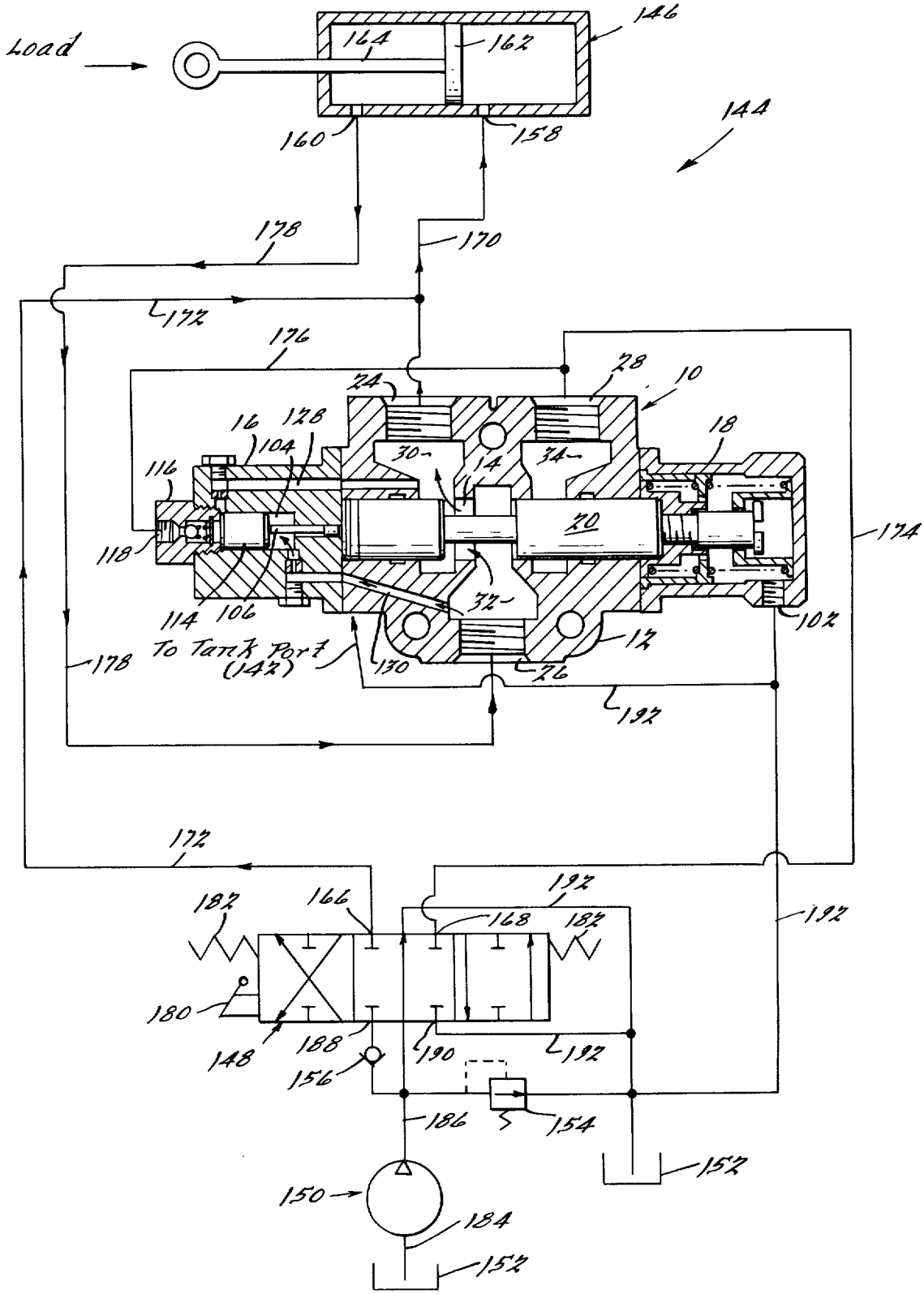
FIG. 5 is a schematic view of a regenerative hydraulic system employing the pressure sensing valve of FIG. 1.

Referring to FIG. 5 a regenerative hydraulic system 144 is illustrated. In addition to pressure sensing valve 10, the system 144 comprises a work cylinder 146, a manual directional valve 148, a fluid supply pump 150, a fluid return tank 152, a relief valve 154, and a check valve 156 in fluid communication with one another through conventional hydraulic lines. The work cylinder 146 is a standard construction well know in the art, having a head side port 158 and a rod side port 160. The work cylinder 146 has a piston 162 and connecting rod 164 the details of which will not be elaborated upon here. However, it is contemplated that virtually any type of hydraulic actuator could be used in its place, the illustrated cylinder 146 being for purposes of example only. The rod 164 encounters a load through an interconnecting mechanism or working element (not illustrated). The head side port 158 of the work cylinder 146 is in fluid communication with port 24 of the pressure sensing valve 10 through fluid line 170. The work port 166 of the directional valve 148 is in fluid communication with fluid line 170 through fluid line 172. Although fluid line 172 is illustrated as terminating directly into fluid line 170, it is contemplated that an additional port could be provided in the actuator housing 12 communicating with cavity 30. Port 28 of the pressure sensing valve 10 is in fluid communication with the return port 168 of the directional valve 148 through fluid line 174. Port 28 is also in fluid communication with port 118 of the pressure sensing valve 10 through fluid line 176. The rod side port 160 of the work cylinder 146 is in fluid communication with port 26 of the pressure sensing valve 10 through fluid line 178.

The directional valve 148 is a three position type well known to those skilled in the art. It is illustrated in schematic view in the center or neutral position. The directional valve 148 is manually controlled by a control mechanism 180 and biasing springs 182. In the position indicated, hydraulic fluid is drawn from the return tank 152 into the pump 150 through a feed line 184. The fluid is then pumped at a constant rate to the directional valve 148 through a source line 186. In a neutral position the hydraulic fluid passes through the directional valve 148 and returns directly to the return tank 152 via fluid line 172. Fluid lines 192 are also connected to ports 102 and 142 of the pressure sensing valve 10 as well as to drain port 190 of the directional valve 148. A relief valve 154 interconnects the source line 186. and the fluid line 192 to provide a drain path for the hydraulic fluid should an overpressure condition occur. In the "power stroke" mode, i.e., when the work cylinder 146 is pushing outwardly, the directional valve 148 connects its fluid source port 188 with the work port 166 and the drain port 190 with the return port 168. During the "return stroke", i.e., when the work cylinder rod 164 is being retracted, the fluid source port 188 is in communication with the return port 168 while the drain port 190 is connected with the work port 166.

In operation, the above described regenerative hydraulic system 144 is in the regenerative position when the valve spool 20 is in the position illustrated. When the valve spool is shifted to the right to interconnect cavities 32 and 34, the system is in the non-regenerative mode. To initiate a power stroke, an operator would switch the directional valve 148 to the power stroke position thereby interconnecting ports 188 with 166 and 190 with 168 of the directional valve 148. In this position fluid would pass from the pump 150 through source line 186, check valve 156, and fluid lines 172 and 170 into the head side of the work cylinder 146. This fluid flow would apply pressure to the head side of the piston 162 causing it to move to the left as illustrated. As the piston 162 moves to the left, fluid contained in the rod side of the work cylinder 146 is displaced thereby and forced into fluid line 178. This fluid enters the pressure sensing valve 10 through port 26 and passes therethrough via cavity 32, bore 14, cavity 30 and out through port 24. The fluid exiting port 24 combines with the fluid from pump 150 passing through fluid line 172 into fluid line 170 which is passing to the head side of the work cylinder 146. In the regenerative mode the effective work area of the work cylinder 146 is the area of the rod. If for example, the area ratio of the head and rod is 2:1, the resulting combined oil flow in fluid line 170 will be twice the pump 150 flow. Hence, the power stroke speed of the cylinder 146 will be doubled. When resistance is met by the rod 164 and its associated mechanism, the line pressure within the fluid lines will increase. This pressure increase will be sensed within the stepped bore 104 through passageways 128 and 130. Because of the pressure differential created across the ends of large pilot piston 114 as hereinabove described, the large pilot piston 114 will be urged to the left while the pressure being sensed through passageway 130 is also impressed upon the crescent flats 138 of the small pilot piston 106 which at a given pressure will push the valve spool 20 to the right thereby interrupting flow between cavities 30 and 32 and interconnecting the cavities 32 and 34. At this point the valve 10 has switched from the regenerative mode to the non-regenerative mode. The hydraulic fluid being displaced from the rod side of the work cylinder 146 will pass from cavity 32 into cavity 34 and into drain line 174 for return to the return tank 152. At this point the fluid being pumped to the head side of the work cylinder 146 is coming exclusively from the pump through fluid lines 172 and 170. When the valve 10 switches from the regenerative to the non-regenerative mode and the fluid being displaced from the rod side of the cylinder 146 is routed to the return tank 152, the system pressure will drop substantially inasmuch as the return tank 152 is effectively at one atmosphere. This drop in pressure will reverse the imbalance or pressure differential across the large pilot piston 114 causing it to be displaced to the right where it abuts the left hand most end of the small pilot piston 106 thereby "latching" the system. Because the surface area of the large pilot piston 114 is substantially greater than that of the small pilot piston 106, a much smaller pressure need be detected through passageway 128 in order to hold the valve 10 in the non-regenerative mode.

After latching has occurred, the power stroke will continue with the piston and connecting rod 162, 164 respectively being displaced to the left but at a substantially reduced rate. When the power stroke is completed, the rod and piston 164, 162 will reach an end limit of travel at which time the system pressure will increase to a maximum value thereby opening the relief valve 154. As long as the directional valve 148 remains in the power stroke position fluid will be pumped through source line 186 returning to the return tank 152 through the relief valve 154. The relatively large pressure differential between that required to initially displace the valve spool 20 from the regenerative position merely to hold the valve spool 20 in the non-regenerative position accounts for the hysteresis characteristic of the present invention which is a major advantage thereof over the prior art.

If the operator wishes the mechanism associated with the rod 164 and piston 162 to remain in the fully deployed position, he would merely shift the directional valve 148 back to the central or neutral position.

To retract the mechanism associated with the rod 164 and piston 162 of the work cylinder 146, the operator initiates a retract cycle by switching the directional valve 148 into the appropriate position thereby interconnecting fluid source port 188 with return port 168 and drain port 190 with work port 166. Once the control valve 148 has been shifted to the neutral position, the pressure being exerted on the large pilot piston drops to a point wherein the valve 10 will become unlatched and and the valve spool 20 will be urged into its first or regenerative position by the spring assembly described hereinabove. In the retracting mode, the hydraulic fluid is pumped through the source line 186, the check valve 156 into fluid line 174. The fluid will enter port 28 of the pressure sensing valve 10 but instantaneously will be blocked by the valve spool inasmuch as it is in the regenerative position. The fluid pressure will thus increase. This pressure will be exerted upon the check valve 116 through port 118 via fluid line 176. The fluid entering through the check valve 116 will exert pressure upon the left hand most end of the large pilot piston 114 causing the valve spool 20 to be urged to the right or into the non-regenerative mode. Once the valve spool has shifted to the right, the fluid passing through fluid line 174 will pass through the valve 10 via cavity 34, bore 14, cavity 32 and out port 26. This fluid will pass through fluid line 178 into the rod side of the work cylinder 146. The pressure will build on the rod side of the work cylinder 146 urging it and its associated mechanism to the right. The fluid on the head side of the work cylinder 146 will thus be displaced into fluid line 170 for return to the return tank 152 via fluid lines 172 and 192. When the work cylinder 146 is fully retracted, the piston 162 and rod 164 will reach their right hand limit of travel and the system pressure will increase to the point which the relief valve 154 will again open to bypass fluid from the pump 150 directly to the return tank 152. This condition will remain until the operator again switches the directional valve 148 to the neutral position.

Referring to FIGS. 6 and 7 a typical application of the above described system is illustrated in the form of a tree harvester 194. The harvester 194 has a front boom 196 projecting forwardly of the body 198 of the harvester 194. In the illustrated example, the working element comprises a pair of shearing blades 200 which are pivotably disposed on the forward most end of the boom 196 in such a manner that when the harvester 194 addresses a tree 202 or the like, the shearing blades 200 embrace and then sever the tree 202 near the ground. After severing the tree 202 the boom 196 is pivoted upwardly and the trunk of the tree 202 is grasped by a delimber mechanism 204 which subsequently supports and strips the tree 202 of its limbs. Although the present invention is only applied to the shearing blades 200 in the present example, it is contemplated that the regenerative system described herein could be applied to other working elements within the harvester 194 such as the delimber mechanism 204.

The shearing blades 200 are shown in their extreme limits of travel 200' and 200'' as well as the intermediate point of travel in which they first embrace the tree 202. Two work cylinders 206 are rigidly affixed to the boom 196, the connecting rods 208 of which are pivotably attached to the shearing blades 200 so as to cause the blades 200 to close upon one another while the connecting rods 208 are being deployed outwardly from the work cylinder 206 forwardly of the harvester 194. At the beginning of a power stroke cycle, i.e., when the blades 200 are in the fully open position 200', the pressure sensing valve associated with the system will be in a regenerative mode thus causing the blades 200 to be displaced relatively quickly until the point in which the blades come in contact with the tree 202. At this point the system fluid pressure will increase substantially causing the valve 10 to switch into the non-regenerative mode as described hereinabove.

Referring to FIGS. 8A and 8B, typical pressure profiles of the system pressure versus time and displacement profiles of cylinder displacement versus time during the power stroke are illustrated. Referring to FIG. 8A, at the initiation of a power stroke the system pressure increases rapidly to overcome the inertia of the mechanism, dropping slightly when the mechanism begins to move and then increases slowly due to acceleration of the mechanism. As the mechanism meets a load, the system pressure again steeply increases until the regenerative cut out pressure is reached. Continuing the example cited hereinabove wherein the work cylinder has a characteristic 2:1 area ratio, an acceptable regenerative cut out pressure for the tree harvester application would be in the area of 2,000 pounds per square inch (PSI). When the regenerative cut out pressure is reached, the hydraulic fluid being displaced within the work cylinder is routed to the return tank thereby momentarily dropping the system pressure. The drop in pressure based on a 2:1 area ratio would be approximately 1,000 PSI to produce the same equivalent force on the load. Because of the large end surface of the large pilot piston, the system pressure must drop down to approximately 350 PSI before the pressure sensing valve will unlatch. Without this hysteretic effect characteristic of the pressure sensing valve, the drop in system pressure due to the switching of the valve from a regenerative mode to the non-regenerative mode would cause the valve to switch back into the regenerative mode. It can be seen that this will create an unstable condition in which the mechanism switches into and out of the regenerative mode out of the control of the operator.

Once the system has switched out of the regenerative mode the system pressure will continue to rise as the power stroke portion of the cycle is completed. When the mechanism has reached an end of travel condition the pressure will increase to a point in which the relief valve 154 will open to bypass the hydraulic fluid directly from the pump into the return tank.

Referring to FIG. 8B, the substantially faster response time of the present system during the power stroke as opposed to the prior art is illustrated. The hydraulic cylinder rod is displaced substantially faster than an equivalent prior art system until the appointed time when the regenerative cut out pressure is reached and the system switches to the non-regenerative mode. From that point on through the completion of the power stroke portion of the cycle, the displacement of the cylinder will be comparable to that of the prior art unit. Note that the total elapsed time for the completion of the power stroke is substantially less with the present invention.

It is contemplated that the present invention can be expanded and applied to devices employing multiple work cylinders such as that illustrated in FIGS. 6 and 7. Additionally, it is contemplated that the regenerative feature and hysteretic effect characteristic could be employed in both the deployment stroke and retraction stroke of one or more work cylinders as well as other types of hydraulic devices which may or may not have linear or reciprocating displacement characteristics.

It is to be understood that the invention has been described with reference to specific embodiments which provide the features and advantages previously described, and that such specific embodiments are susceptible to modification, as will be apparent to those skilled in the art. Accordingly, the foregoing description is not to be construed in a limiting sense.

What is claimed is:

1. A pressure sensing valve comprising:

a housing having a longitudinal bore therein;

a plurality of ports in fluid communication with said bore at spaced points therealong;

valve plunger means disposed within said bore for slidable displacement between first and second positions to selectively interconnect a first pair of said ports for fluid communication therebetween in said first position and a second pair of said parts for fluid communication therebetween in said second position;

biasing means urging said plunger means axially towards said first position;

first and second pilot pistons slidably disposed in first and second pilot bores respectively, said first pilot piston of a diameter substantially smaller than that of said second pilot piston, said pilot bores being disposed substantially coaxially with said longitudinal bore, said second pilot bore communicating with said longitudinal bore through said first pilot bore wherein one end of said first pilot piston abuts one end of said second pilot piston and the other end of said first pilot piston abuts one end of said plunger means while in said first position, said first pilot piston having at least one flat means partially therealong to establish fluid communication between said second pilot bore and said longitudinal bore after said first pilot piston has been axially displaced a predetermined increment of distance while urging said valve plunger means from said first position to said second position;

a first fluid path interconnecting one of said ports with said second pilot bore for transmitting fluid pressure to simultaneously urge the first pilot piston against said plunger means and the second pilot piston away from said plunger means; and a second fluid path interconnecting another of said ports with said second pilot bore for transmitting fluid pressure to urge the second pilot piston against the first pilot piston.

2. The pressure sensing valve of claim 1, further comprising an adjustable stop threadably engaged coaxially with said valve plunger means to establish a first position limit of travel for said valve plunger means.

3. The pressure sensing valve of claim 1, wherein said valve plunger means has a reduced diameter partially therealong.

4. The pressure sensing valve of claim 1, wherein said biasing means comprises a first spring having a first spring rate and a second spring having a second spring rate.

5. The pressure sensing valve of claim 4, wherein said first spring rate is substantially less than said second spring rate.

6. The pressure sensing system of claim 1, further comprising at least one orifice disposed within at least one of said fluid paths.

7. The pressure sensing system of claim 1, further comprising a first orifice interconnecting said first fluid path with said second pilot bore at a point proximate said first pilot bore.

8. The pressure sensing system of claim 7, further comprising a second orifice interconnecting said second fluid path with said second pilot bore at a point distal said first pilot bore.

9. The pressure sensing system of claim 8, wherein said second orifice operates to create a larger fluid pressure drop than said first orifice when said valve plunger means is in first position.

10. A regenerative hydraulic system comprising a source of fluid pressure;

a hydraulic actuator including axially reciprocating piston means disposed therein;

a pressure sensing valve connected with said pressure source and actuator for fluid communication therebetween, said valve comprising;

a housing having a longitudinal bore therein;

a plurality of ports in fluid communication with said bore at spaced points therealong;

valve plunger means disposed within said bore for slidable displacement between first and second positions to selectively interconnect a first pair of said ports for fluid communication therebetween in said first position and a second pair of said ports for fluid communication therebetween in said second position;

biasing means urging said plunger means towards said first position;

first and second pilot pistons slidably disposed in first and second pilot bores respectively, said first pilot piston of a diameter substantially smaller than that of said second pilot piston, said pilot bores being disposed substantially coaxially with said longitudinal bore, said second pilot bore communicating with said longitudinal bore through said first pilot bore wherein one end of said first pilot piston abuts one end of said second pilot piston and the other end of said first pilot piston abuts one end of said plunger means while in said first position, said first pilot piston having at least one flat means partially therealong to establish fluid communication between said second pilot bore and said longitudinal bore after said first pilot piston has been axially displaced a predetermined increment of distance while urging said valve plunger means from said first position to said second position;

a first fluid path interconnecting one of said ports with said second pilot bore for transmitting fluid pressure to simultaneously urge the first pilot piston against said plunger means and the second pilot piston away from said plunger means; and a second fluid path interconnecting another of said ports with said second pilot bore for transmitting fluid pressure to urge the second pilot piston against the first pilot piston.

11. The regenerative hydraulic system of claim 10, further comprising a three position directional valve in fluid communication with said source of fluid pressure, work cylinder and pressure sensing valve, said directional valve effecting bi-directional control of said work cylinder piston means.

12. The regenerative hydraulic system of claim 10, wherein said hydraulic actuator comprises a hydraulic cylinder.

13. The apparatus of claims 1 or 10, wherein said housing defines a first port, a second port and an intermediate inlet/exhaust port, said first pair comprising said first and said intermediate ports, and said second pair comprising said second and said intermediate ports.

* * * * *